US007775009B2

(12) United States Patent
King

(10) Patent No.: US 7,775,009 B2
(45) Date of Patent: Aug. 17, 2010

(54) SYSTEM FOR PROVIDING A DECORATIVE COVERING ON A SUPPORT SURFACE USING PANELS WITH INTERLOCKS

(75) Inventor: Daniel W. King, Copley, OH (US)

(73) Assignee: Tapco International Corporation, Wixom, MI (US)

( * ) Notice: Subject to any disclaimer, the term of this patent is extended or adjusted under 35 U.S.C. 154(b) by 654 days.

(21) Appl. No.: 11/613,470

(22) Filed: Dec. 20, 2006

(65) Prior Publication Data

US 2007/0144095 A1 Jun. 28, 2007

Related U.S. Application Data

(60) Provisional application No. 60/753,199, filed on Dec. 22, 2005.

(51) Int. Cl.
*E04D 1/34* (2006.01)

(52) U.S. Cl. ..... 52/520; 52/529; 52/530; 52/531; 52/539; 52/547

(58) Field of Classification Search ..... 52/519, 52/520, 522, 523, 528, 529, 530, 531, 538, 52/539, 545, 546, 547, 548, 554, 555
See application file for complete search history.

(56) References Cited

U.S. PATENT DOCUMENTS 3,504,467 A * 4/1970 Caulfield et al. ..... 52/309.1
3,593,479 A 7/1971 Hinds et al.
4,130,974 A 12/1978 Chalmers et al.
4,292,781 A 10/1981 Chalmers et al.
4,399,643 A 8/1983 Hafner
4,468,909 A 9/1984 Eaton
4,598,522 A 7/1986 Hoofe, III
5,224,318 A 7/1993 Kemerer
5,347,784 A 9/1994 Crick et al.
5,363,623 A 11/1994 King
5,392,579 A * 2/1995 Champagne ..... 52/520
5,575,127 A 11/1996 O'Neal
5,775,042 A 7/1998 Mowery et al.
5,878,543 A * 3/1999 Mowery ..... 52/519
5,946,876 A * 9/1999 Grace et al. ..... 52/520
6,050,041 A 4/2000 Mowery et al.
6,065,260 A 5/2000 Dickey et al.
6,170,215 B1 1/2001 Nasi
6,301,856 B1 10/2001 Nasi (Continued)

*Primary Examiner*—Richard E Chilcot, Jr.
*Assistant Examiner*—Chi Q Nguyen
(74) *Attorney, Agent, or Firm*—Howard & Howard Attorneys PLLC

(57) ABSTRACT

A system for decoratively covering a support surface is provided. The system comprises a plurality of panels. Each panel includes a top, a bottom, and first and second ends. Each panel includes a nailing hem for mounting the panel to the support surface. Each panel also includes first and second rows of decorative portions simulating building materials. A riser interconnects the first and second rows. Each panel further includes a flap extending from the riser at the first end and a catch extending from the riser at the second end. The flap and catch mate with a corresponding catch and flap of horizontally adjacent panels. The flap and catch are both sloped upwardly toward the top at an acute angle to provide a mating fit between corresponding flaps and catches.

22 Claims, 7 Drawing Sheets

U.S. PATENT DOCUMENTS 6,341,464 B1 1/2002 Dickey et al.
6,367,220 B1 * 4/2002 Krause et al. ..... 52/512
6,393,792 B1 5/2002 Mowery et al.
6,635,218 B2 10/2003 King
6,684,587 B2 2/2004 Shaw et al.
6,874,290 B1 4/2005 Bokan
2003/0097810 A1 5/2003 Leichtfried
2003/0131552 A1 7/2003 Leichtfried
2004/0159062 A1 8/2004 Donlin et al.

* cited by examiner

SYSTEM FOR PROVIDING A DECORATIVE COVERING ON A SUPPORT SURFACE USING PANELS WITH INTERLOCKS

RELATED APPLICATIONS

This application claims the benefit of U.S. Provisional Patent Application Ser. No. 60/753,199, filed on Dec. 22, 2005, the advantages and disclosure of which are hereby incorporated by reference.

FIELD OF THE INVENTION

The present invention relates to a system for providing a decorative covering on a support surface such as on a wall of a building. More specifically, the present invention relates to the system having a plurality of panels with interlocks for securing adjacent panels together on the support surface.

BACKGROUND OF THE INVENTION

Prior art systems that utilize panels to provide a decorative covering on a support surface are well known in the art. For decades, vinyl siding panels have been mounted on exterior walls of buildings to cover, protect, and decorate the exterior walls. Generally, these panels are positioned adjacent to one another for covering the exterior wall of the building and, often, the panels include interlocks for securing adjacent panels to one another. U.S. Pat. No. 4,598,522 to Hoofe III illustrates one such system.

In Hoofe III, each of the panels includes a top, a bottom, and first and second ends. A mounting flange is adjacent to the top for securing the panels to a support surface. Each of the panels also includes upper and lower rows of decorative portions. The lower row of decorative portions has a lower edge adjacent to the bottom of the panel. A plurality of pockets are defined in the lower edge. The upper row of decorative portions has an upper edge adjacent to the mounting flange. A plurality of protruding elements are disposed on the upper edge and extend upwardly from the upper edge for mating with the pockets defined in the lower edge of a vertically adjacent panel. As a result, the cooperating pockets and protruding elements act as interlocks for vertically adjacent panels to prevent horizontal shifting of the panels.

Other prior art systems utilize interlocks that are located on the ends of overlapping panels. In U.S. Patent Application Publication No. 2004/0159062 to Donlin et al., each of the panels includes a top, a bottom, and first and second ends. A first overlap portion is adjacent to the first end and a second overlap portion is adjacent to the second end. The first overlap portion overlaps the second overlap portion of a horizontally adjacent panel. The first overlap portion includes a plurality of upwardly extending hooks. The second overlap portion defines a plurality of corresponding slots. As a result, the hooks are inserted into the slots defined in the horizontally adjacent panel to secure the panels to one another when mounting the panels on a support surface.

One draw back to the prior art interlocks is that the interlocks are often difficult to manufacture into the panel and may result in installation problems because they include elements that protrude from the panel. These types of interlocks are also subject to damage during manufacturing and transportation due to their protruding nature. Therefore, it would be advantageous to provide an interlock in the overlapping end regions that overcomes such problems to secure horizontally adjacent panels to one another.

SUMMARY OF THE INVENTION AND ADVANTAGES

The present invention provides a system for decoratively covering a support surface using a plurality of panels. Each of the panels has a top, a bottom, and first and second ends. A mounting flange is adjacent to the top to facilitate mounting of the panel to the support surface. A first row of decorative portions is disposed between the top and bottom to define a first front face and a second row of decorative portions is disposed between the top and bottom to define a second front face. A riser connects the first and second rows such that the first row is in a stepped relationship with the second row. A first overlap portion is adjacent to the first end and a second overlap portion is adjacent to the second end. The first overlap portion overlaps the second overlap portion of a horizontally adjacent panel mounted to the support surface. A first interlock, having an inner surface, extends from the riser at the first end. A second interlock, having an outer surface, extends from the riser at the second end. The inner and outer surfaces are defined as abutting surfaces sloped upwardly toward the top at an acute angle relative to at least one of the first and second front faces wherein the inner surface overlies and abuts the outer surface of the horizontally adjacent panel at the acute angle. This connection reduces relative movement between the panels when mounted on the support surface.

In another aspect of the present invention, the first interlock includes a flap and the second interlock is further defined as a catch.

The present invention provides an interlock between overlapping ends of adjacent panels that overcomes the problems that characterize the prior art. Specifically, the first and second interlocks of the present invention are unobtrusive and are easily formed into the panels when the panels are manufactured. Further, since the first and second interlocks do not protrude from the panel, there is little or no chance of the interlocks being damaged during manufacturing and transportation.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1:
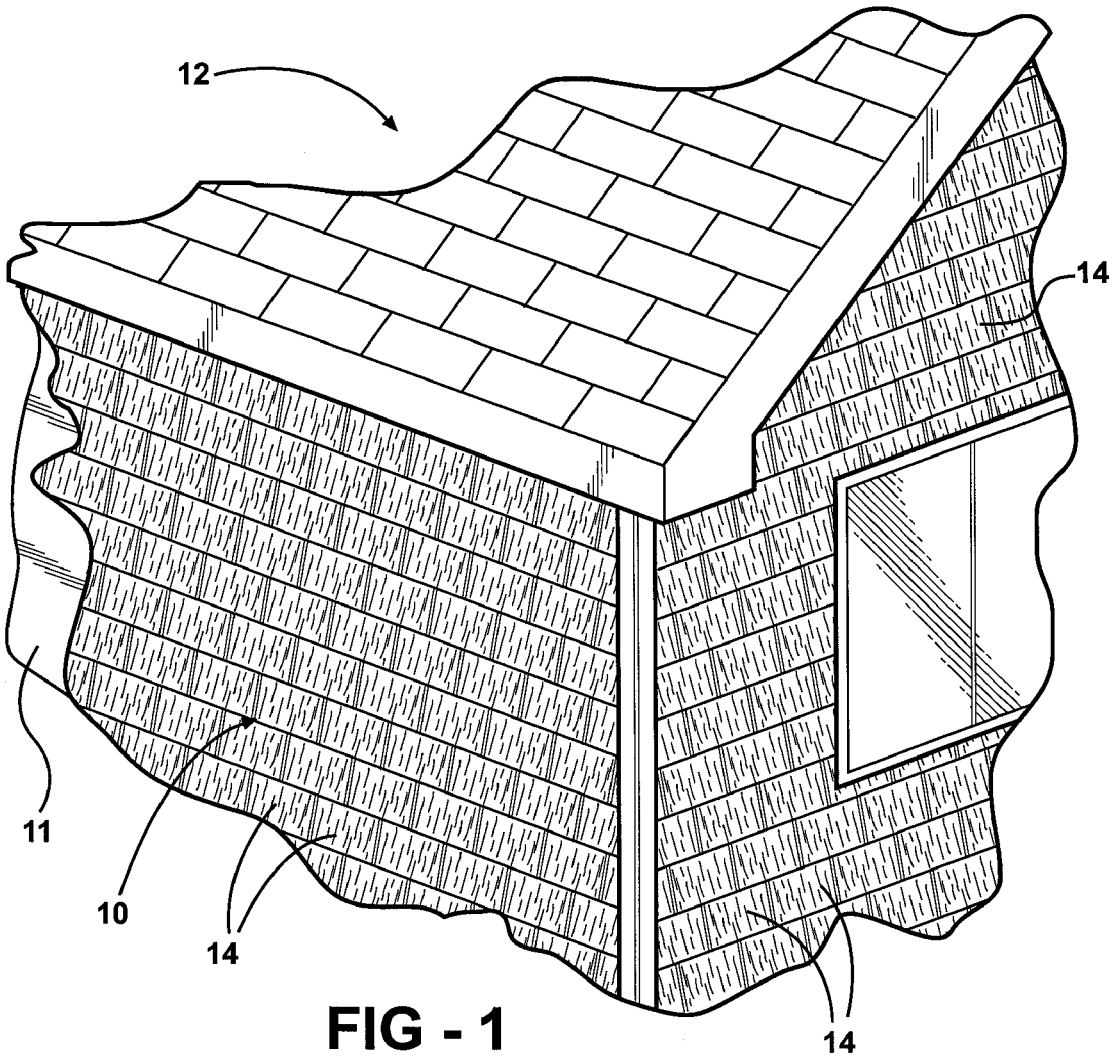
FIG. 1 is a perspective view of a building with a system of the present invention providing a decorative covering for exterior walls of the building.

Referring to the Figures, wherein like numerals indicate like or corresponding parts throughout the several views, a system for providing a decorative covering on a support surface 11 is generally shown at 10 in FIG. 1. The system 10 comprises a plurality of interlocking panels 14 for mounting to the support surface 11. The panels 14 are positioned adjacent to one another to cover the support surface 11. The system 10 preferably covers exterior support surfaces, such as those on exterior walls of buildings (see building 12 illustrated in FIG. 1). In this instance, the panels are referred to as "siding" panels. In alternative embodiments, the system 10 may cover other surfaces or structures. The panels 14 are placed on the support surface 11 in a number of courses using methods well known to those skilled in the art. The dimensions of the panels 14, such as length, may vary depending on the desired course layout of the panels 14.

Figure 2:
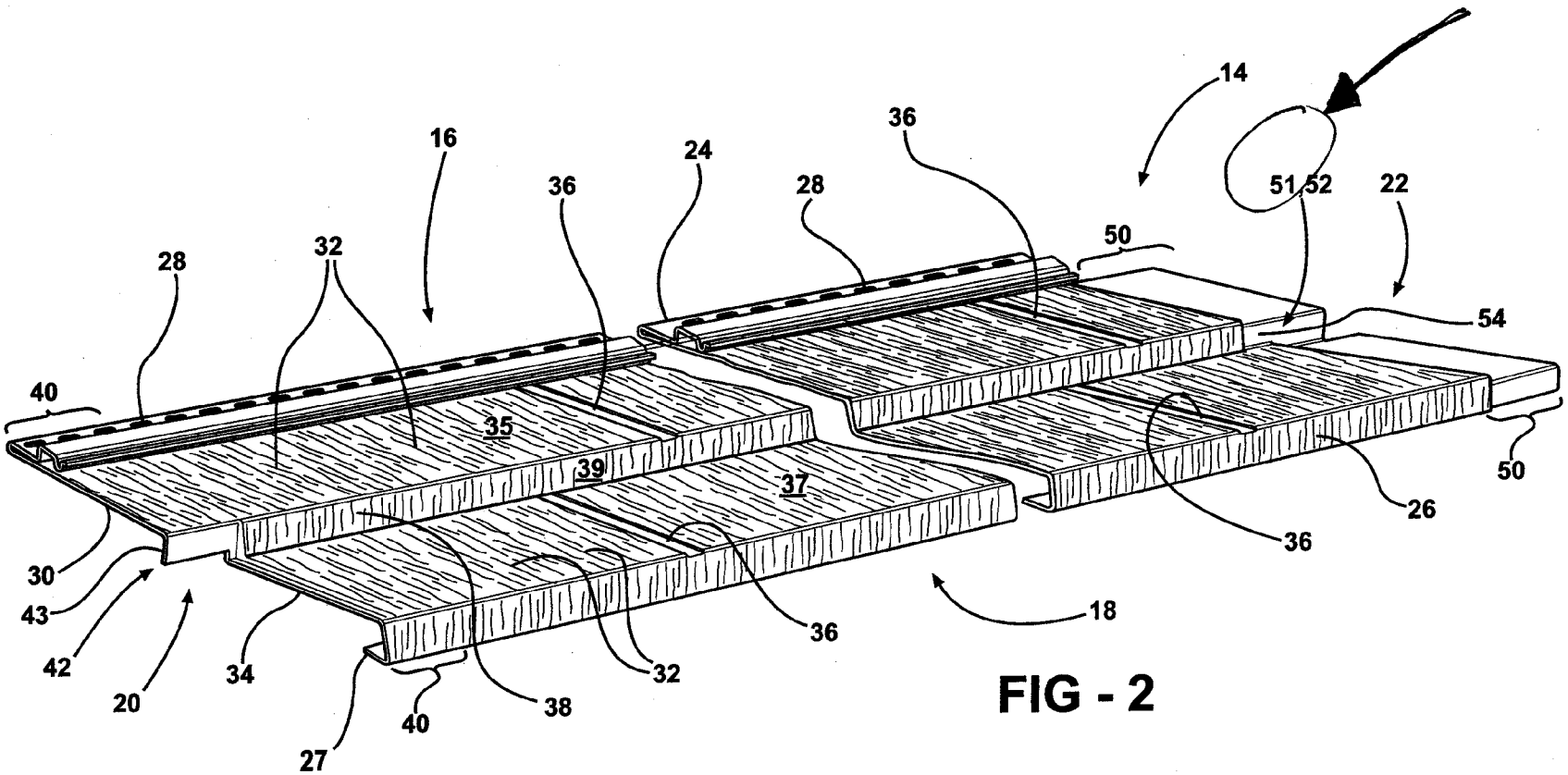
FIG. 2 is a front perspective view of a panel of the system forming the decorative covering.
Figure 3:
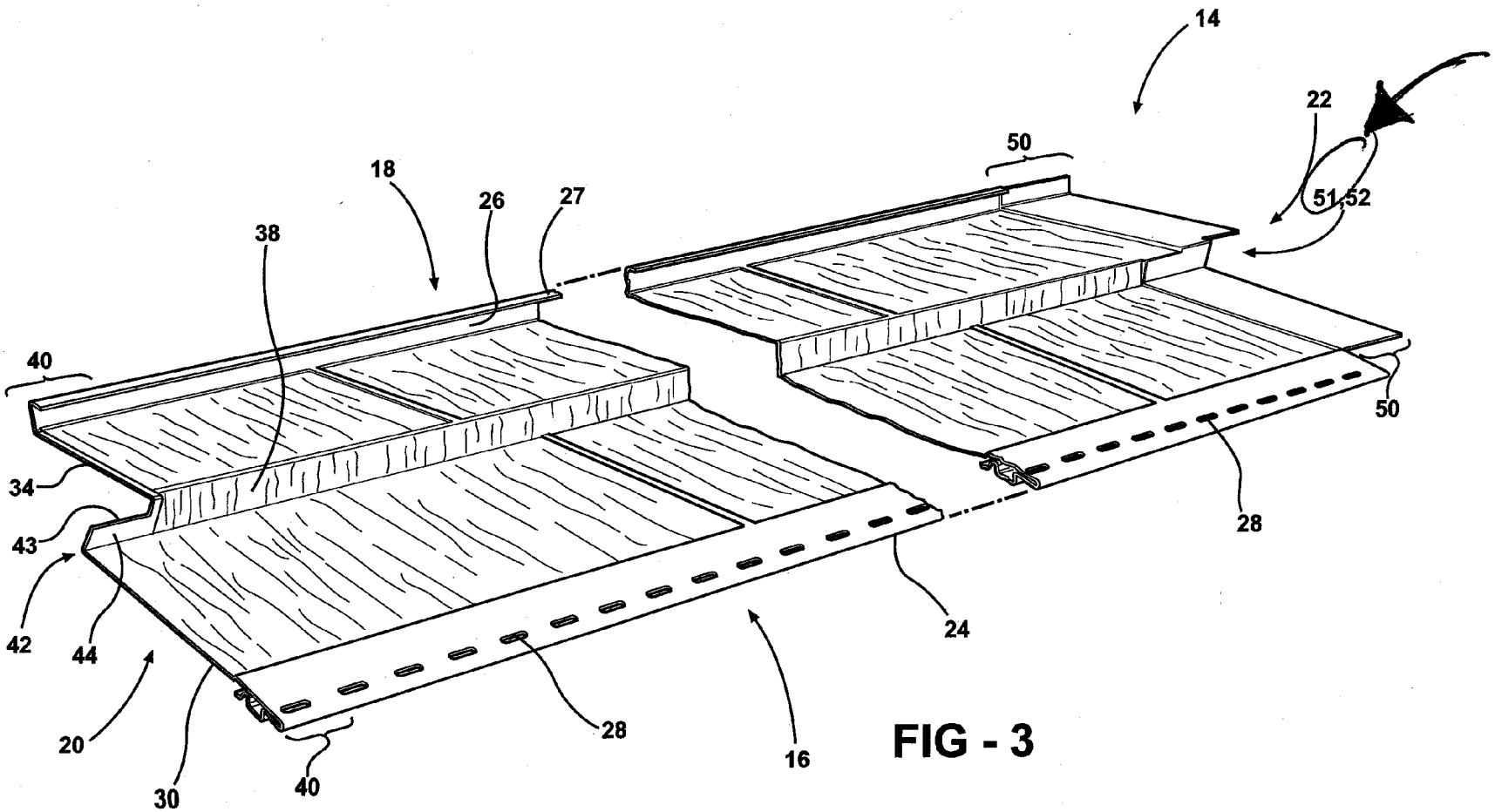
FIG. 3 is a rear perspective view of the panel forming the decorative covering.

Referring to FIGS. 2 and 3, front and rear perspective views of one embodiment of the panel 14 used in the system 10 is shown. In the preferred embodiment, each of the panels 14 is substantially similar such that each of the panels 14 can interlock with any other panel 14. Each of the panels 14 is preferably formed from a unitary sheet of material and has a top 16, a bottom 18, and first 20 and second 22 ends. The sheet of material is preferably a rigid thermoplastic, such as polyvinylchloride or "vinyl." Each panel 14 defines a mounting flange 24 adjacent to the top 16. The mounting flange 24 is used to mount the panel 14 to the support surface. The mounting flange 24 is also referred to as a nailing hem 24. The nailing hem 24 is generally flat and has apertures 28 for receiving fasteners to secure the panel 14 to the support surface 11. The nailing hem 24 is preferably folded onto itself as is well known to those in the siding art to increase strength and stability of the panel 14.

A butt flange 26 is disposed adjacent to the bottom 18, opposite the nailing hem 24. The butt flange 26 generally has a height that is greater than the nailing hem 24. Preferably, the butt flange 26 has a generally hook-shaped clamping portion adjacent the bottom 18 comprising a flexible lip 27 for insertion under the folded over nailing hem 24. The folded over nailing hem 24 cooperates with the flexible lip 27 of vertically adjacent panels 14 to secure the panels 14 to one another in a manner well known to those skilled in the art.

The panel 14 defines a first row 30 of decorative portions 32 and a second row 34 of decorative portions 32. The first 30 and second 34 rows are disposed, one above the other, between the top 16 and bottom 18. More specifically, the first 30 and second 34 rows are disposed between the nailing hem 24 and the butt flange 26 and the rows 30, 34 extend between the first 20 and second 22 ends. These types of panels 14 are generally known as double panels 14, e.g., double-4, double-5 panels. The first row 30 of decorative portions 32 defines a first front face 35 of the panel 14 and the second row 34 of decorative portions 32 defines a second front face 37 that is generally parallel to the first front face. Each of the front faces preferably has a width of from about 3 to about 6 inches, more preferably from about 4 to about 5 inches.

Each row 30, 34 is formed from a series of generally rectangular molds, each having a different and distinct appearance to create the decorative portions 32. Preferably, the decorative portions 32 are impressions of real, authentic wood shake siding such that the panels 14, when collectively mounted to the support surface 11, resembles real wood shake siding. Of course, the panels 14 could also be formed to simulate other building materials.

A plurality of grooves 36 are defined in the front faces 35, 37 of the rows 30, 34 between adjacent decorative portions 32 to divide the decorative portions 32. The grooves 36 are substantially flat and recessed from the decorative portions 32 to further create the appearance of real, authentic wood shake siding. Preferably, each of the grooves 36 is disposed transversely across the front faces 35, 37. The grooves 36 in the first front face 35 are horizontally offset from the grooves 36 in the second front face 37 when viewing the panels 14 from the top 16 to the bottom 18.

A riser 38 is disposed longitudinally between the first 30 and second 34 rows to connect the first row 30 to the second row 34 such that the first row 30 is in a stepped relationship with the second row 34. The riser 38 extends between the first 20 and second 22 ends. The riser 38 further enhances the appearance of the separate decorative portions 32 and further creates the appearance of separate rows 30, 34. The riser 38 has a shadow face 39 generally perpendicularly connecting the first 35 and second 37 front faces of the first 30 and second 34 rows.

A first overlap portion 40 of the panel 14 is disposed adjacent to the first end 20 and a second overlap portion 50 is disposed adjacent to the second end 22. The first overlap portion 40 overlaps the second overlap portion 50 of a second, horizontally adjacent panel (See FIG. 5) that has been previously mounted to the support surface 11. As a result, the second overlap portion 50 of the horizontally adjacent panel is hidden by the first overlap portion 40 of the panel 14. The second overlap portion 50 is recessed relative to the first 35 and second 37 front faces to define an abutment for the first overlap portion 40 and regulate an amount of overlap between adjacent panels 14 and guide mating of the panels 14.

A first interlock 42 extends from the riser 38 at the first end 20 and a second interlock 51 extends from the riser 38 at the second end 22. The first interlock 42 is configured for interlocking with the second interlock 51 of the horizontally adjacent panel to secure the panels 14 together on the support surface 11. The first interlock 42 is preferably formed as part of the first overlap portion 40. The first interlock 42 includes a bent flap 43 extending from the riser 38 at the first end 20. Referring specifically to FIG. 3, the flap 43 has an inner surface or first abutting surface 44 that is inclined or sloped upwardly toward the top 16. The flap 43 also has an outer surface that is exposed when mounted to the support surface 11. As a result, the outer surface preferably has a stylized portion thereon. However, the stylized portion may be omitted, as in FIG. 2. Referring specifically to FIG. 2, the second interlock 51 is further defined as a catch 52 for receiving the flap 43. The catch 52 includes a recessed portion for receiving the flap 43. The catch 52 has an outer surface or a second abutting surface 54 sloped upwardly toward the top 16.

Figure 4:
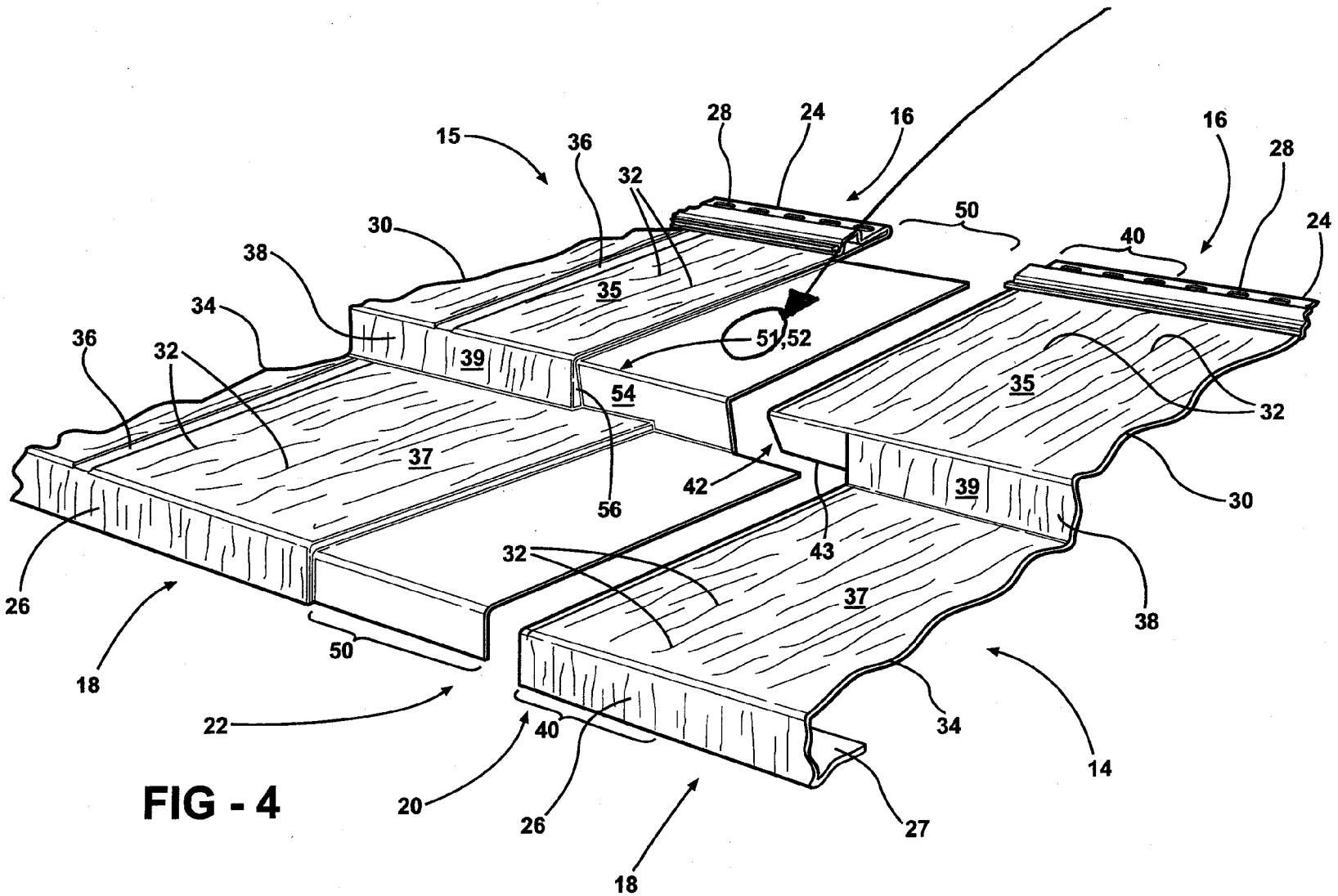
FIG. 4 is a front perspective view of the first end of a first panel spaced from a second end of a second, horizontally adjacent panel prior to engagement with the second end having a second interlock with an outer surface.
Figure 5:
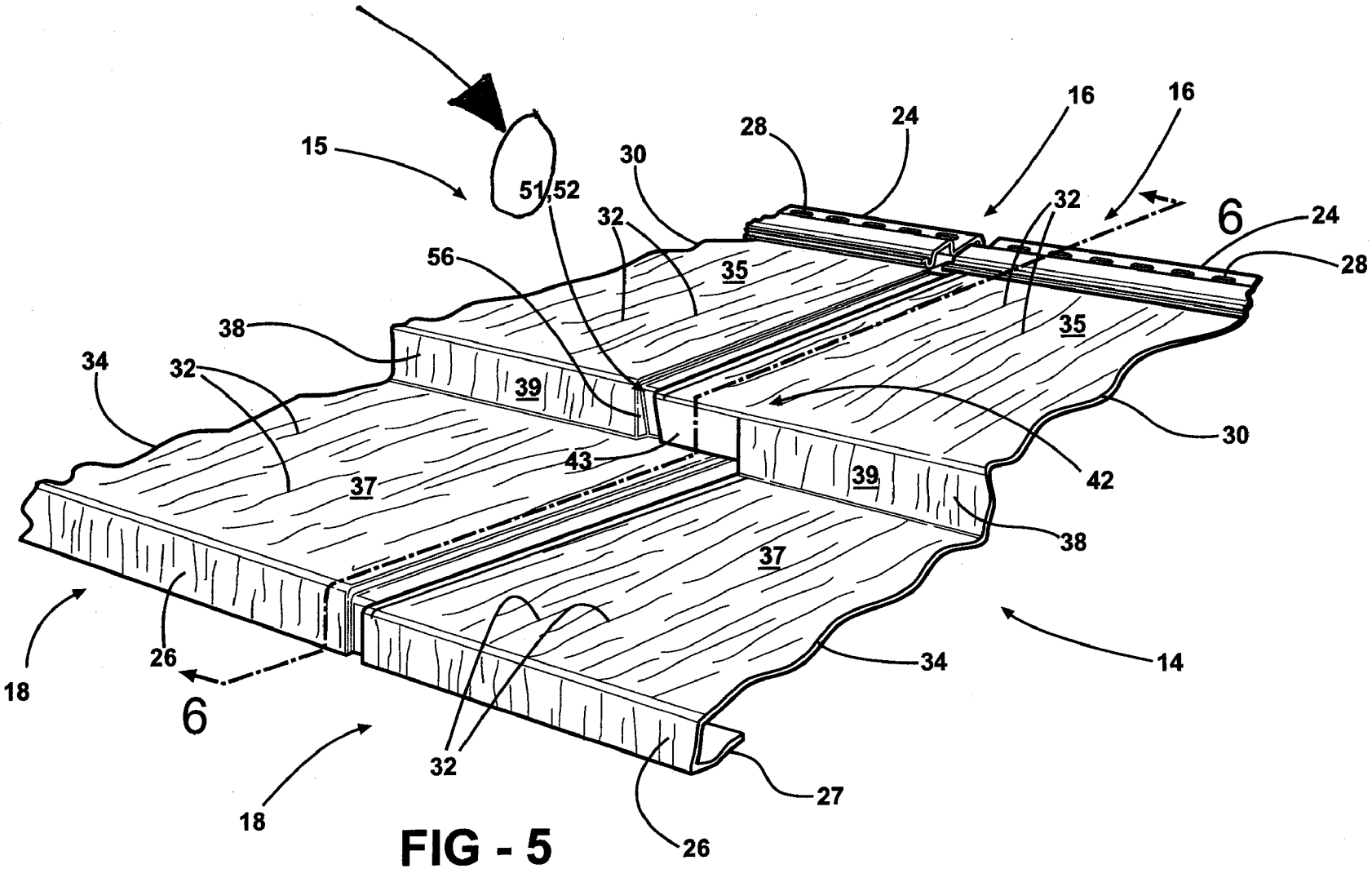
FIG. 5 is a front perspective view of the first panel fully engaging the second panel shown in FIG. 4.

FIG. 4 illustrates the panel 14 having the first end 20 aligned to engage the second end 22 of a second, horizontally adjacent panel 15. The first overlap portion 40 of the panel 14 overlaps the second overlap portion 50 of the second panel 15 such that the first 42 and second 52 interlocks of the panels 14, 15 contact one another and the first 44 and second 54 abutting surfaces create a mating fit therebetween. FIG. 5 illustrates the panel 14 fully engaging the second panel 15. The flexible lip 27 of the clamping portion that is disposed in the first overlap portion 40 flexes over the second overlap portion 50 at the bottom 18 of the second panel 15 to secure the panels 14, 15 together at the bottom 18.

As shown in FIG. 4, the first overlap portion 40 of the panel 14 includes a first overlapping section (see numeral 40 near the top 16) at one end of the first row 30 and a second overlapping section (see numeral 40 near the bottom 18) at one end of the second row 34. These sections are offset from one another. Likewise, the second overlap portion 50 of the second panel 15 includes a first overlapping section (see numeral 50 near the top 16) extending from one end of the first row 30 and a second overlapping section (see numeral 50 near the bottom 18) extending from one end of the second row 34. These sections are also offset from one another. As a result, the first overlapping sections and the second overlapping sections of the overlap portions 40, 50 are complementary to one another to fit together as shown. By providing the offsets, when the overlap portions 40, 50 fit together as shown in FIG. 5, a gap between the decorative portions 32 in the first row 30 is offset from a gap between the decorative portions 32 in the second row 34. This further provides the authentic cedar shake appearance.

Referring again to FIGS. 4 and 5, a contact wall 56 interconnects the riser 38 and the catch 52 such that the riser 38 rises above the catch 52 to define an abutment. The contact wall 56 extends substantially perpendicular to the riser 38 to guide the flap 43 of the panel 14 into mating engagement with the catch 52. As shown in FIG. 5, when the panels 14, 15 are assembled together, the flap 43 is fitted into the catch 52 such that a gap is maintained between the flap 43 and the contact wall 56.

Figure 6A:
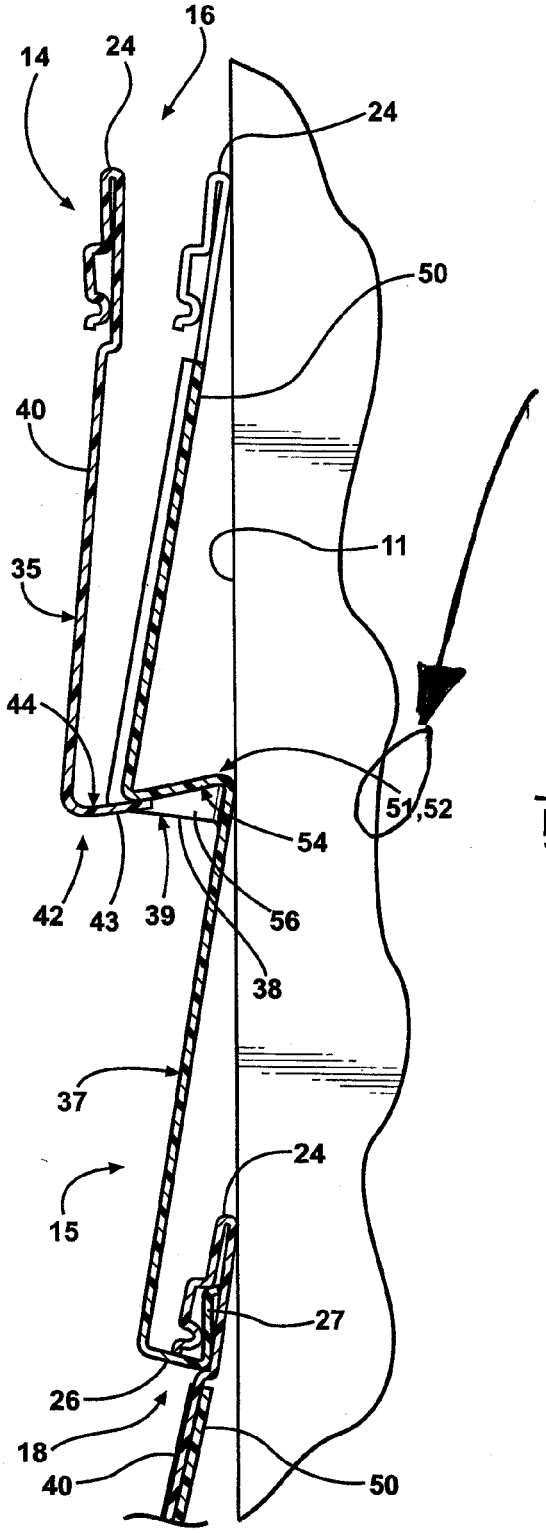
FIGS. 6A and 6B are cross-sectional views taken generally along line 6-6 in FIG. 5 illustrating the overlap of the horizontally adjacent panels and, more specifically, illustrating overlying and abutment of the inner and outer surfaces of the first and second interlocks.
Figure 6B:
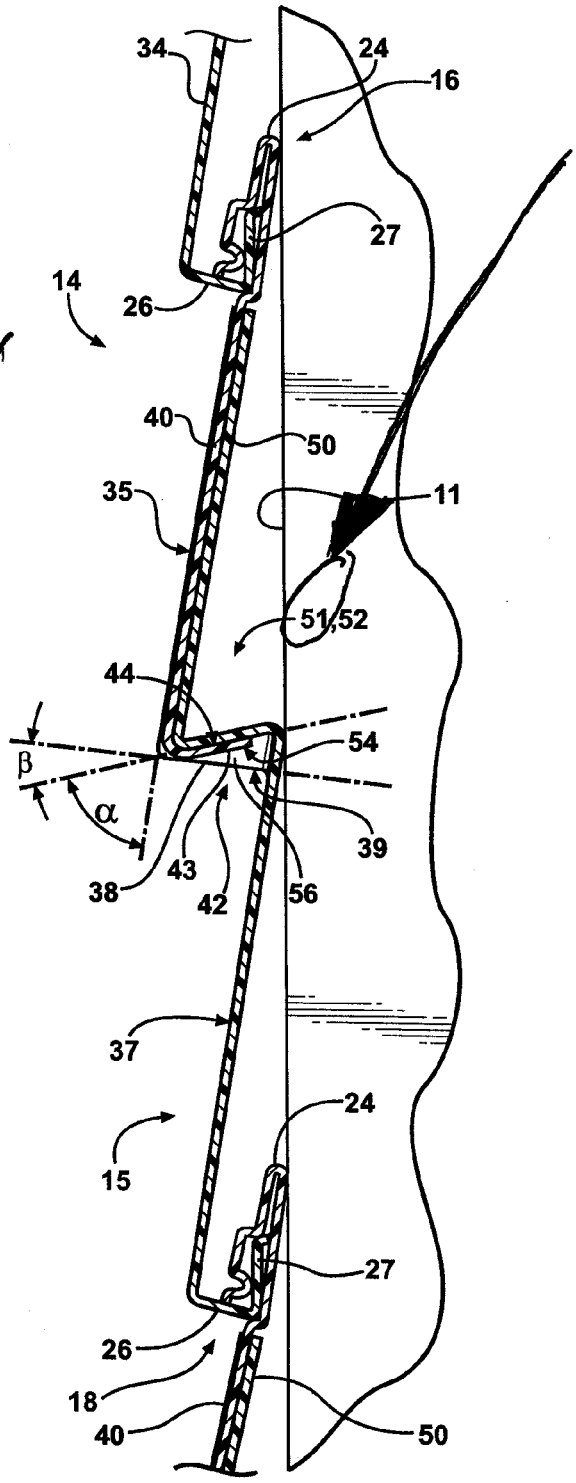

Referring to FIGS. 6A and 6B cross-sectional views taken generally along line 6-6 in FIG. 5 are shown. FIG. 6A shows the first panel 14 as it is installed horizontally next to the second panel 15, which is already mounted to the support surface 11. More specifically, FIG. 6A illustrates the first interlock 42 of the first panel 14 engaging the second interlock 51 of the second panel 15. As can be seen, the first abutting surface 44 abuts the second abutting surface 54. This fit provides for improved stability of the panels 14, 15 when mounted to the support surface 11, e.g., the exterior surface of the building 12, and limits the vertical movement of such panels 14, 15. FIG. 6B illustrates the first panel 14 interlocked and installed with the second panel 15 on the support surface 11. FIG. 6B also illustrates additional courses of the panels 14 installed above the first 14 and second 15 panels to illustrate the fit between the nail hem 24 and the flexible lip 27 of vertically adjacent panels.

As shown in FIG. 6B, the first abutting surface 44 is inclined or sloped upwardly toward the top 16 at a first acute angle $\alpha$ relative to the generally parallel first 35 and second 37 front faces. The first abutting surface 44 forms a second acute angle $\beta$ with the shadow face 39. The first acute angle $\alpha$ is preferably less than 90 degrees, more preferably from about 25 degrees to about 85 degrees, and most preferably from about 65 degrees to about 80 degrees. The second acute angle $\beta$ is preferably greater than 0 degrees, more preferably from about 5 degrees to about 65 degrees, and most preferably from about 10 degrees to about 25 degrees. The second abutting surface 54 slopes upwardly toward the top 16 at the same first acute angle $\alpha$ relative to the first 35 and second 37 front faces. The second abutting surface 54 forms the same second acute angle $\beta$ with the shadow face 39. The first abutting surface 44 overlies the second abutting surface 54 of the horizontally adjacent panel 15 to reduce relative movement between the panels 14, 15.

Figure 7:
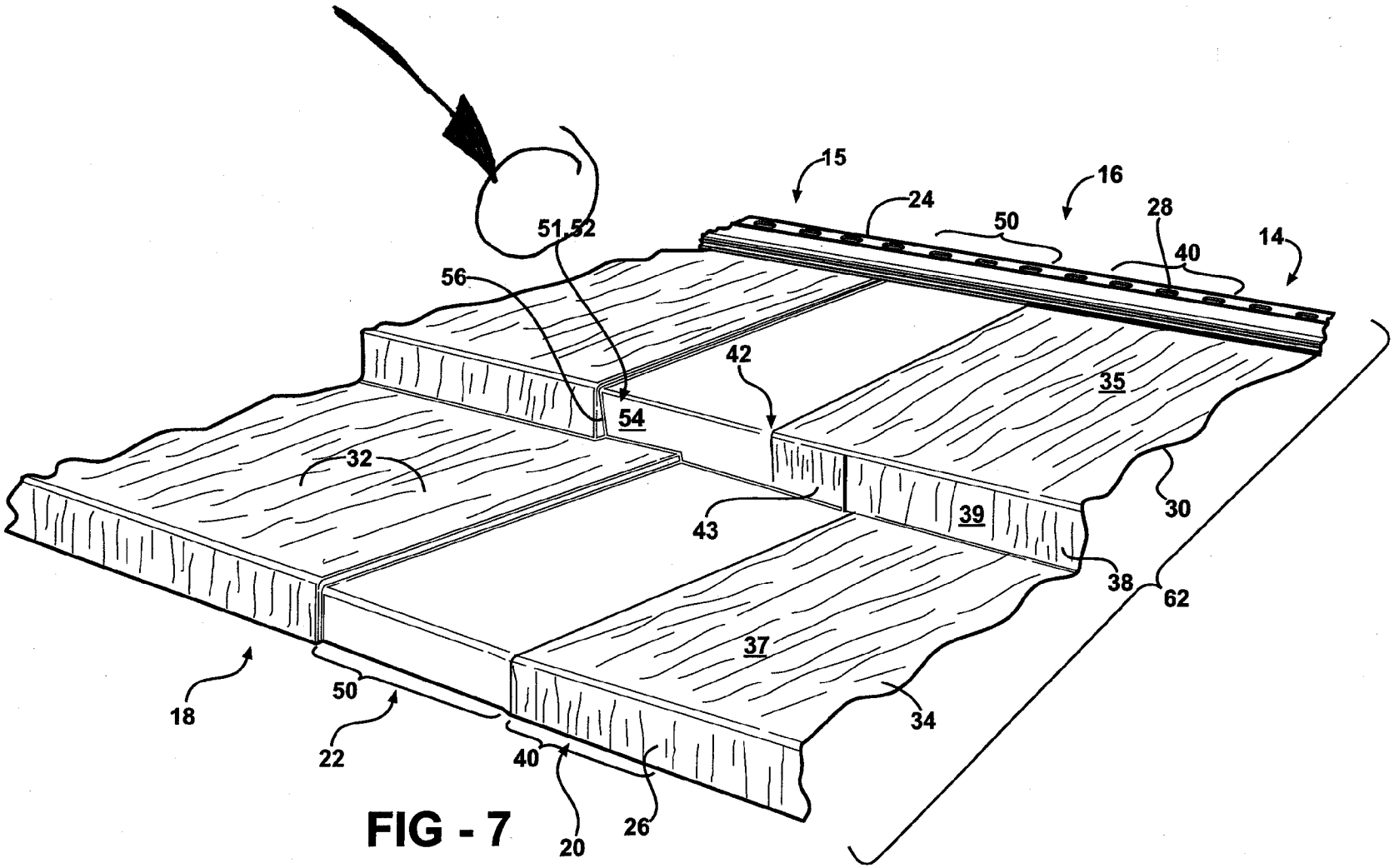
FIG. 7 is a front perspective view of the panels integrated in a continuous strip of material formed from a vacuum-forming method.
Figure 2:
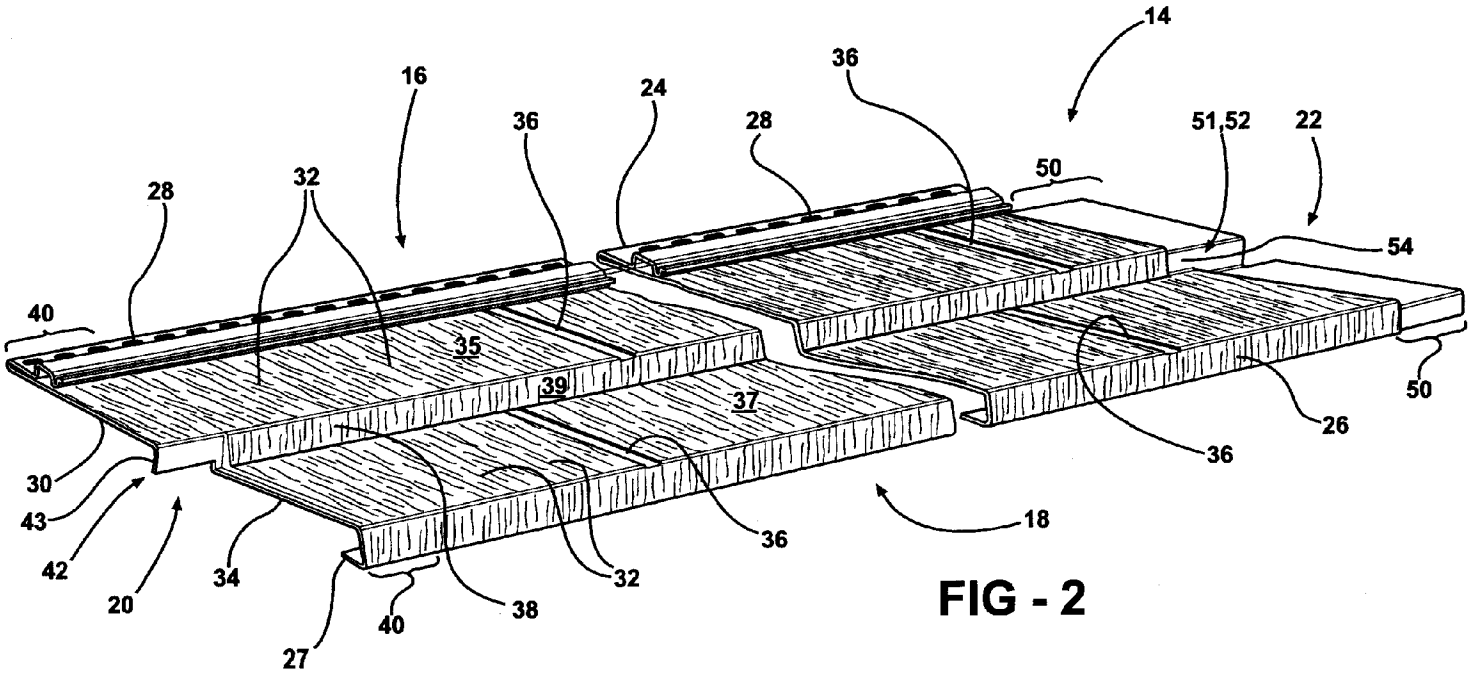
Figure 3:
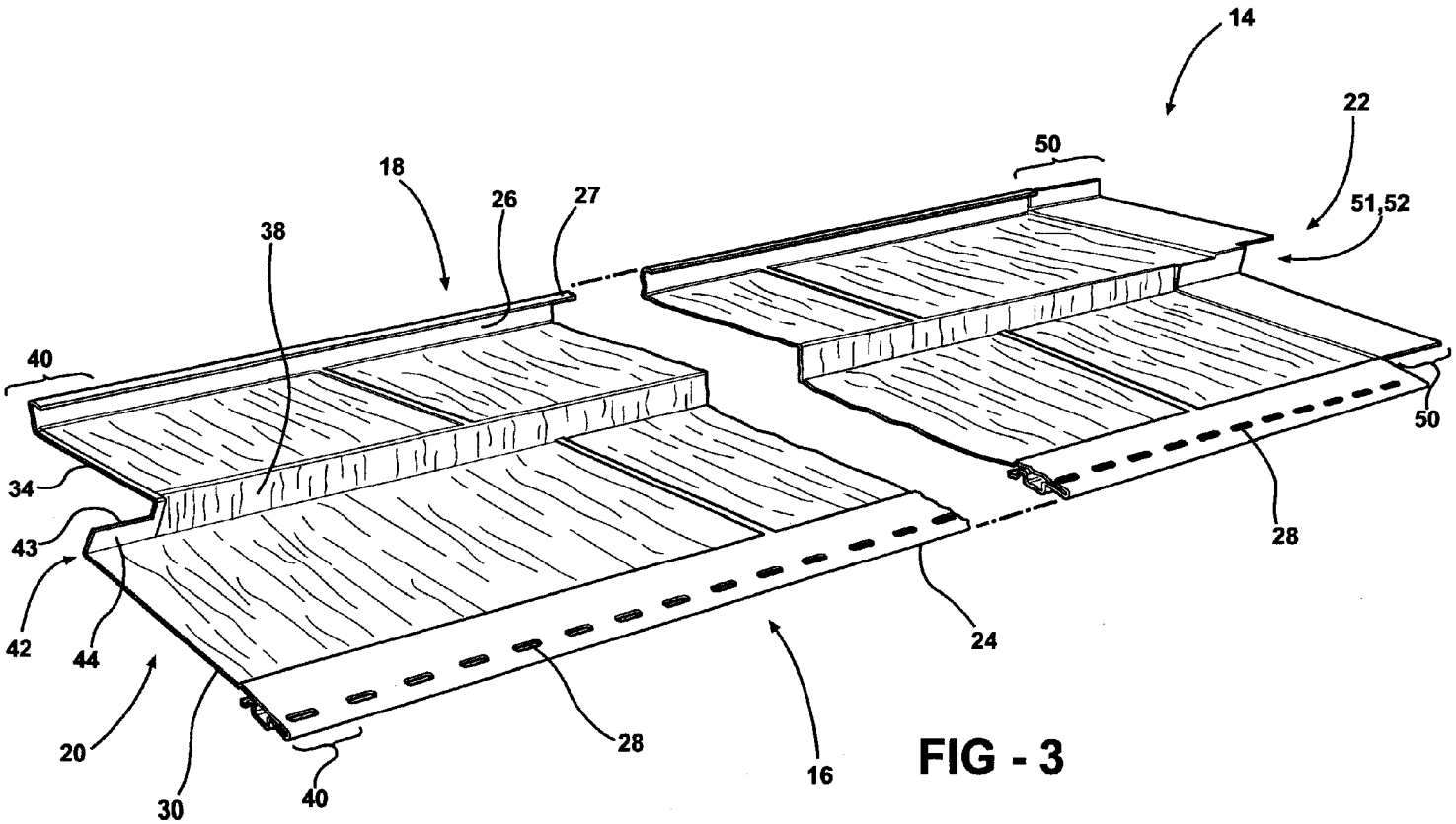
Figure 4:
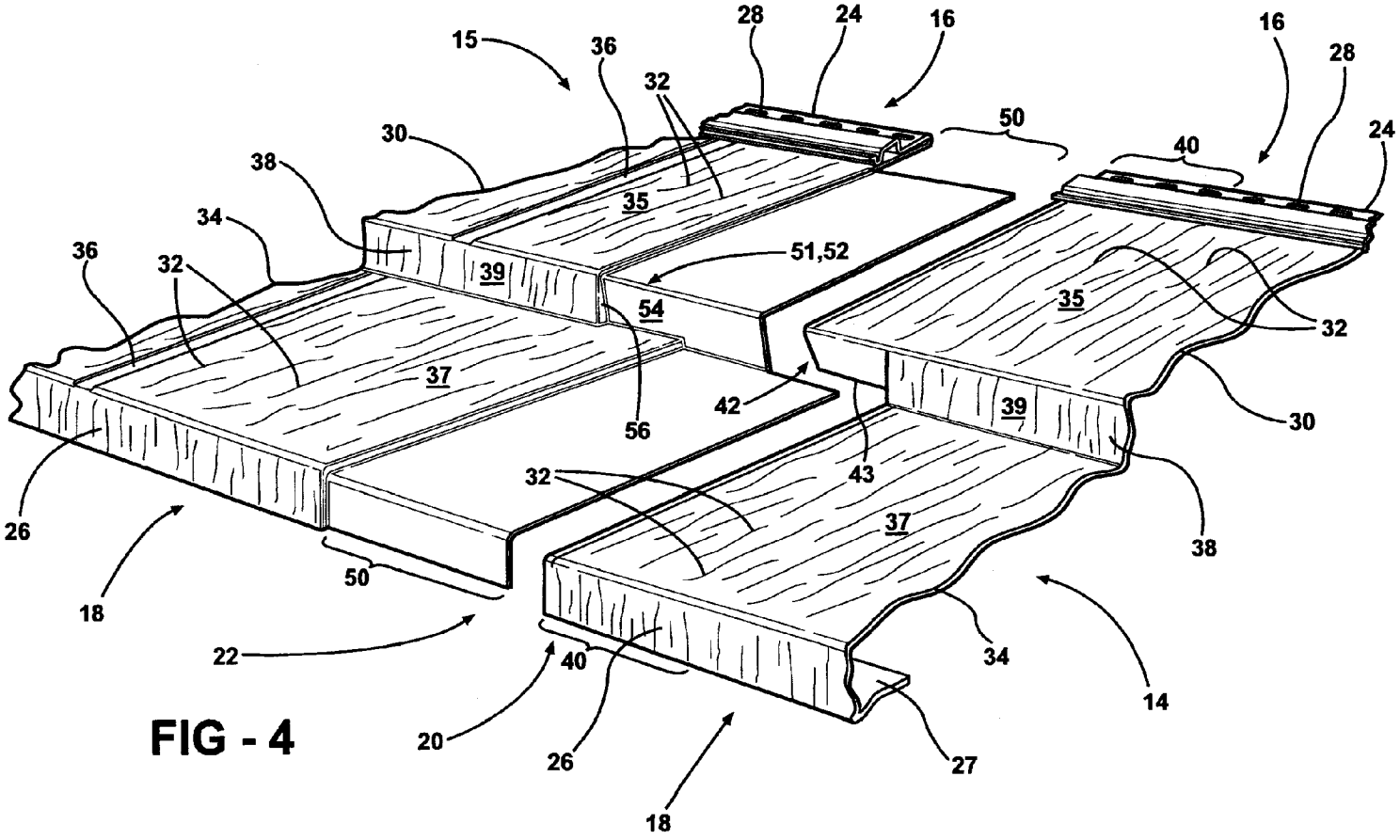
Figure 5:
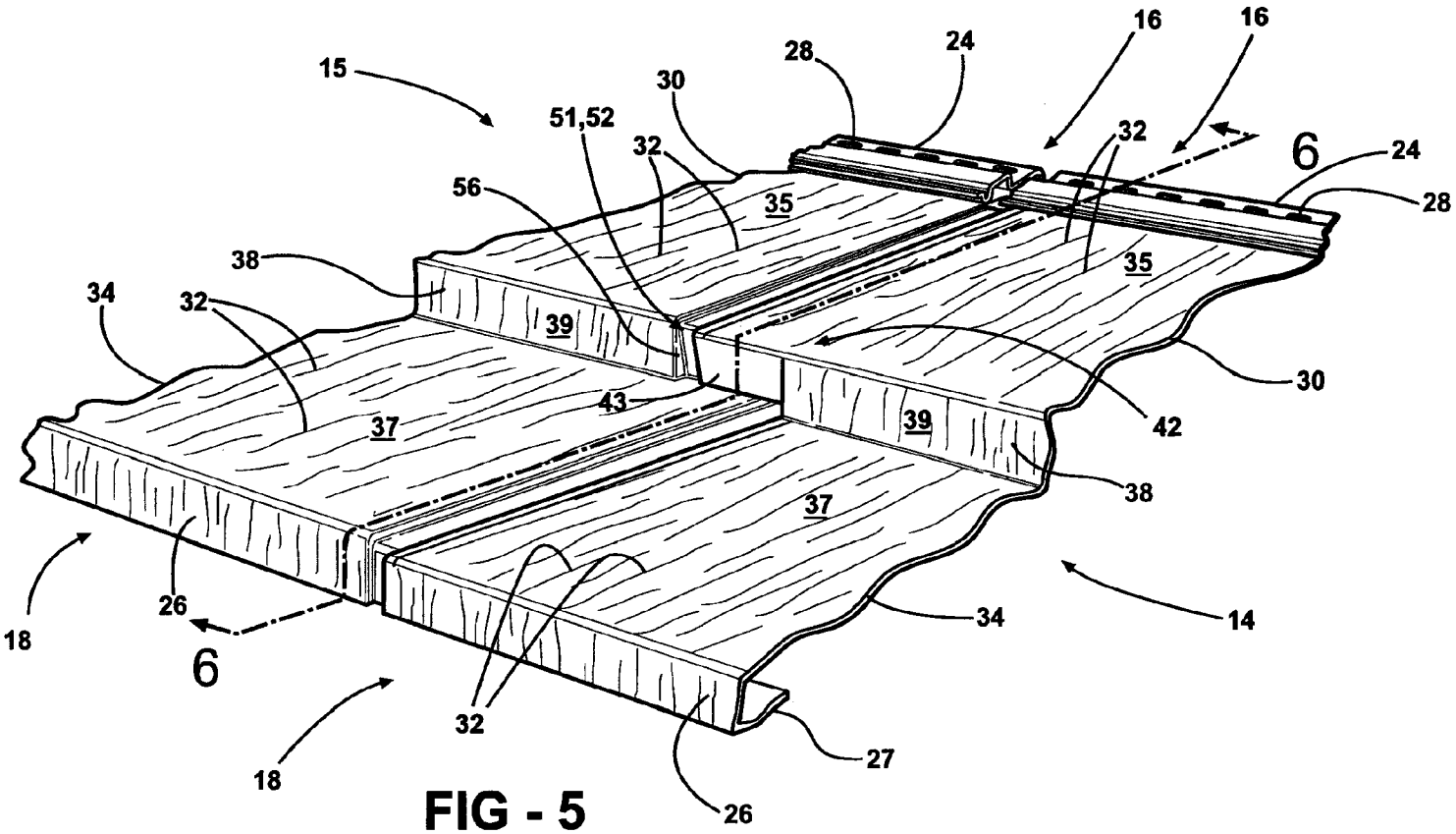
Figure 6A:
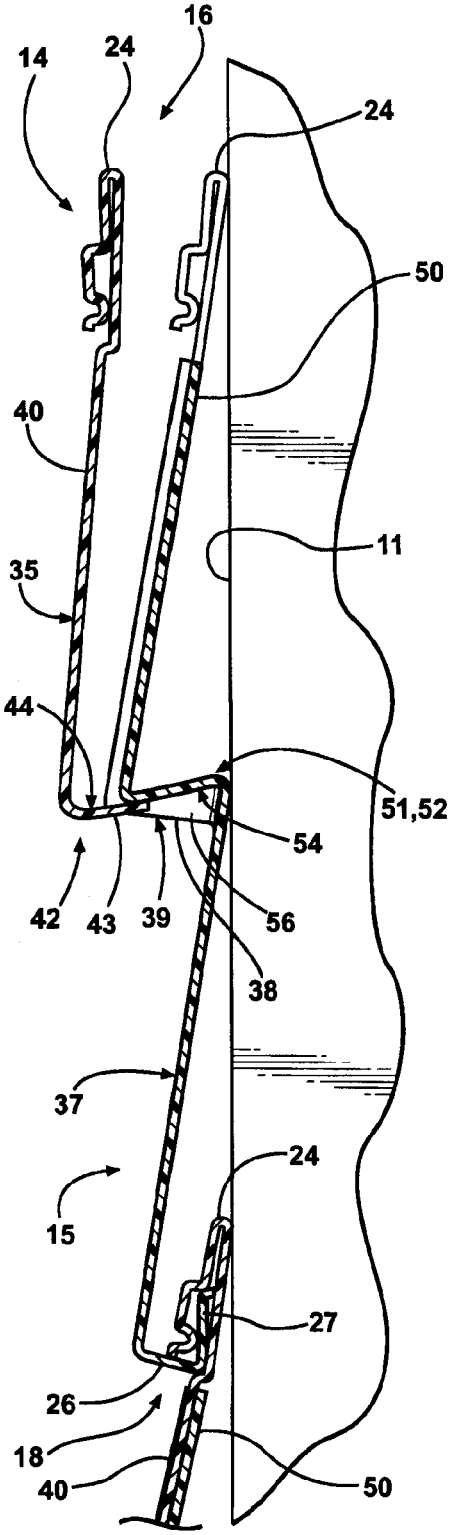
Figure 6B:
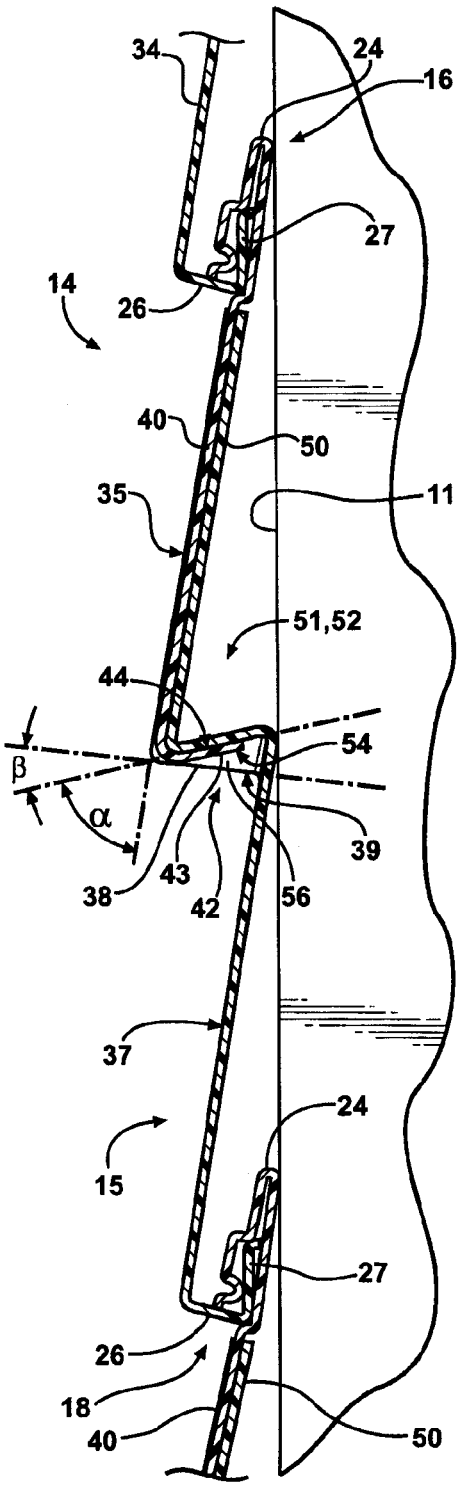
Figure 7:
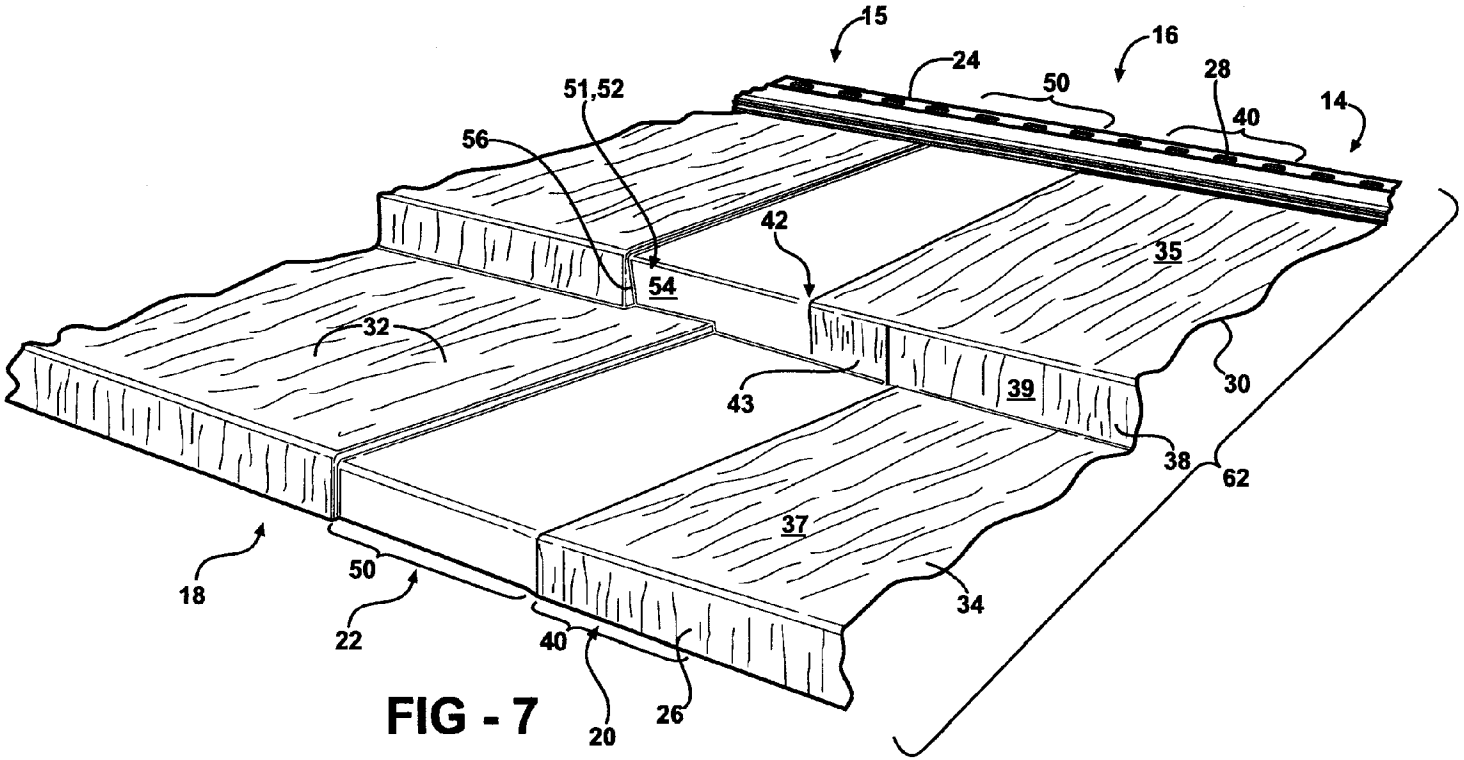
Figure 2:
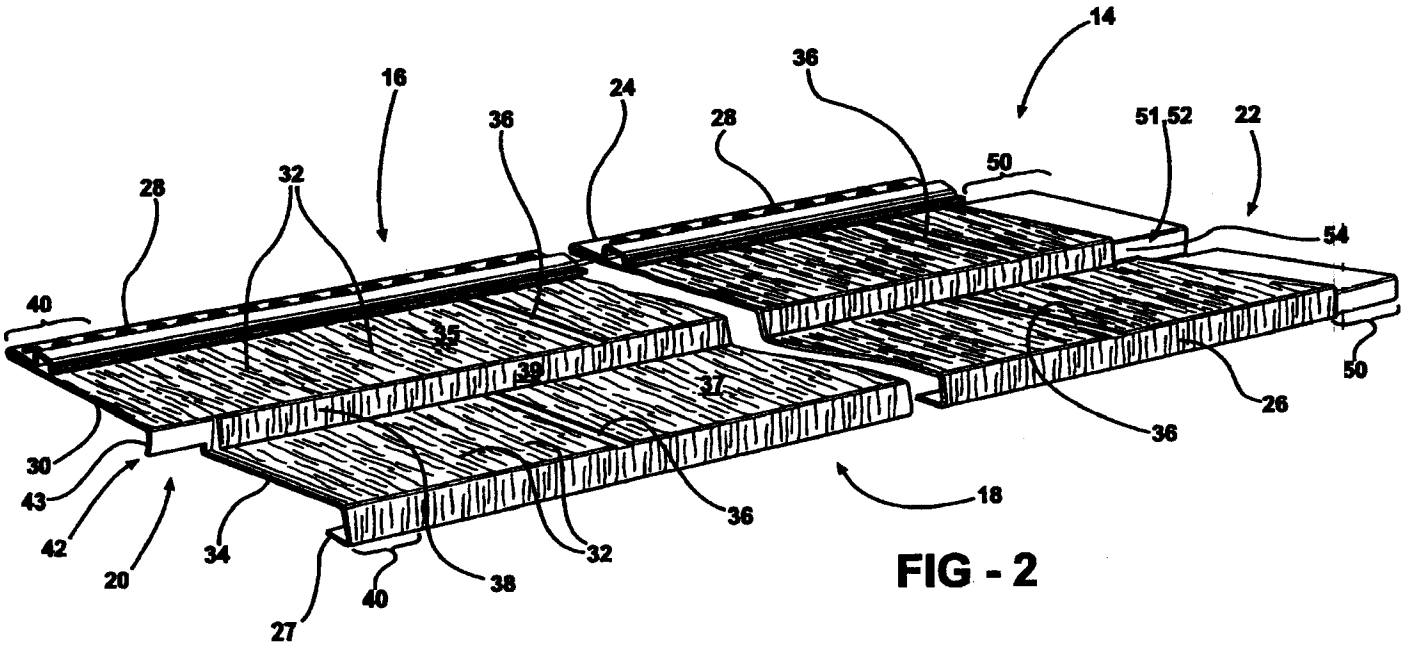
Figure 3:
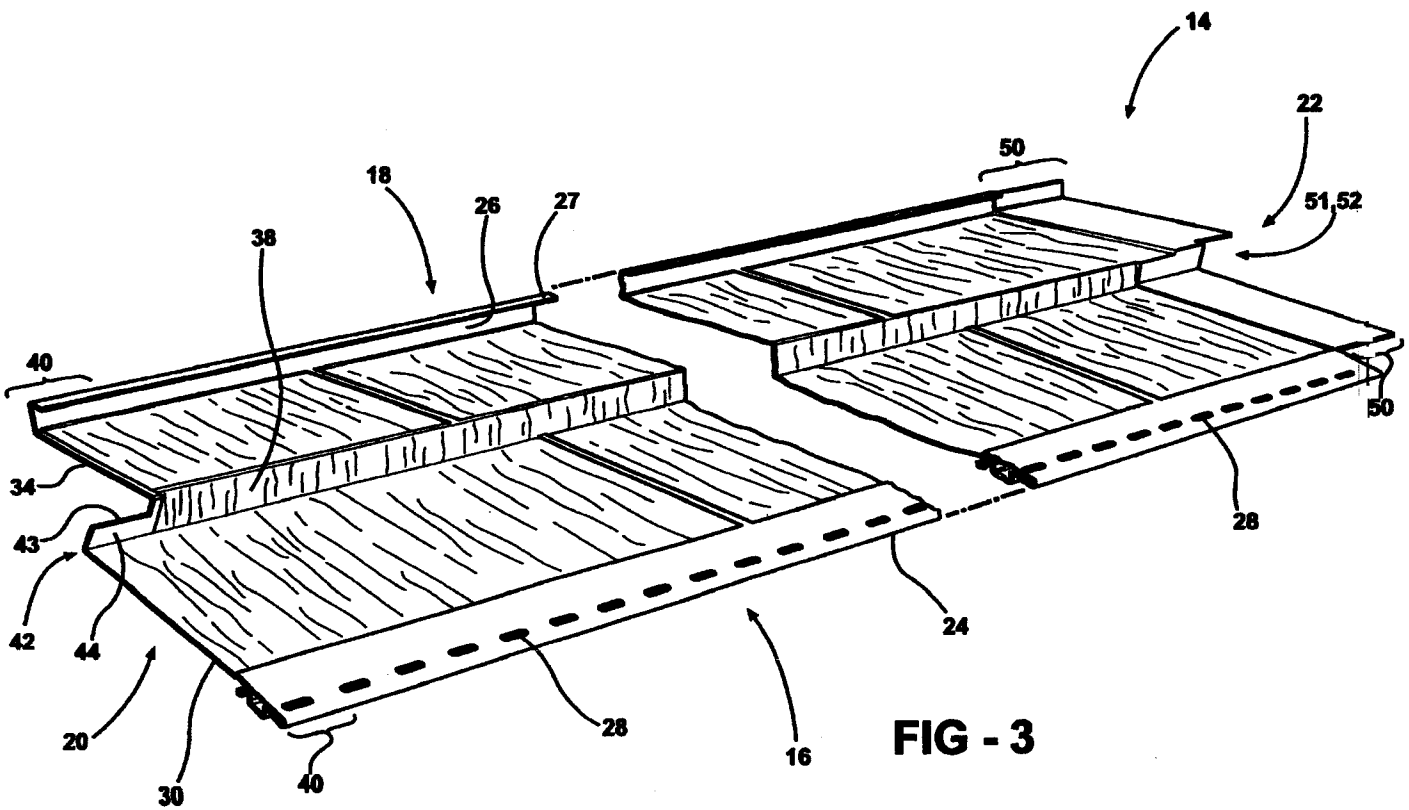
Figure 4:
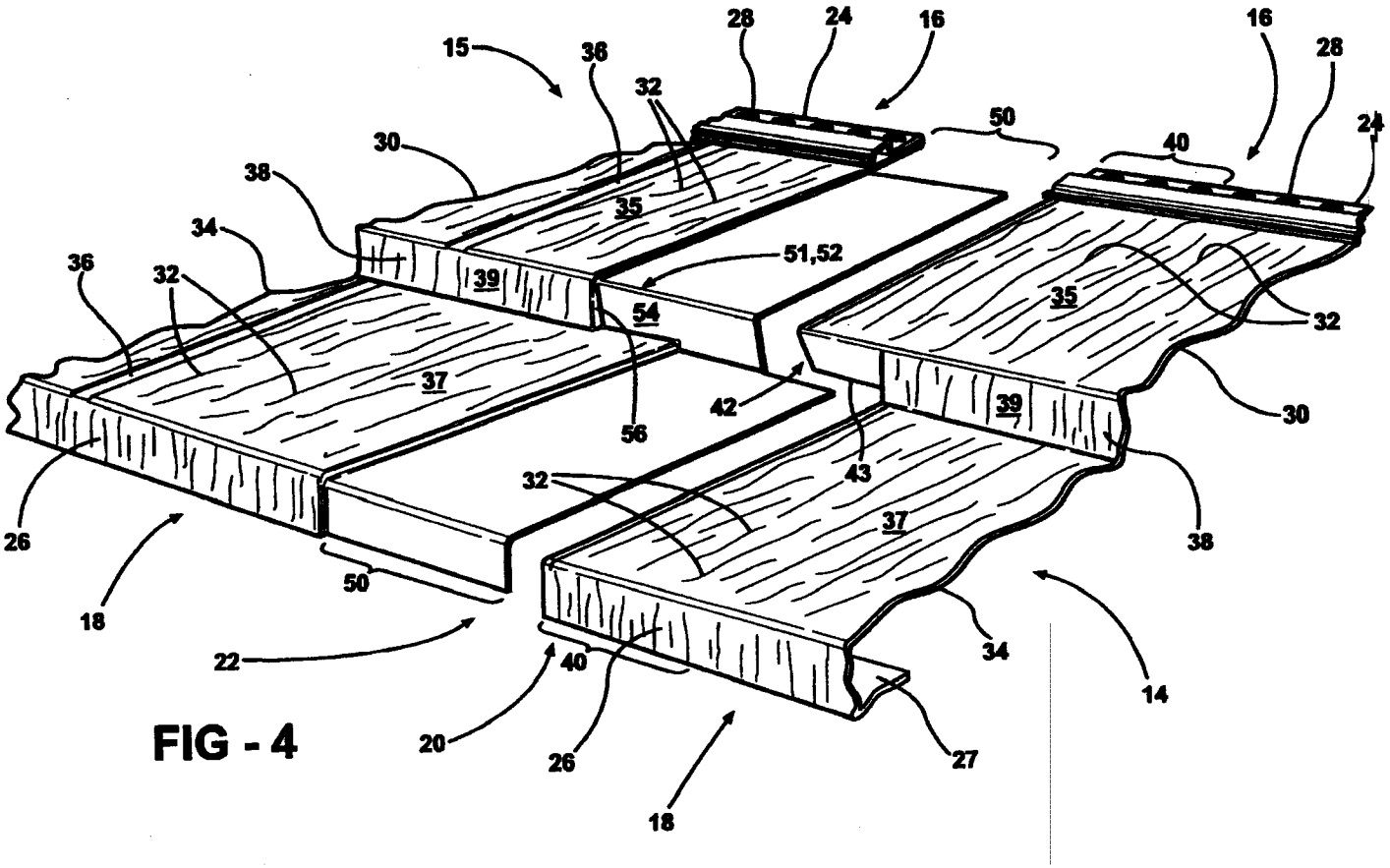
Figure 5:
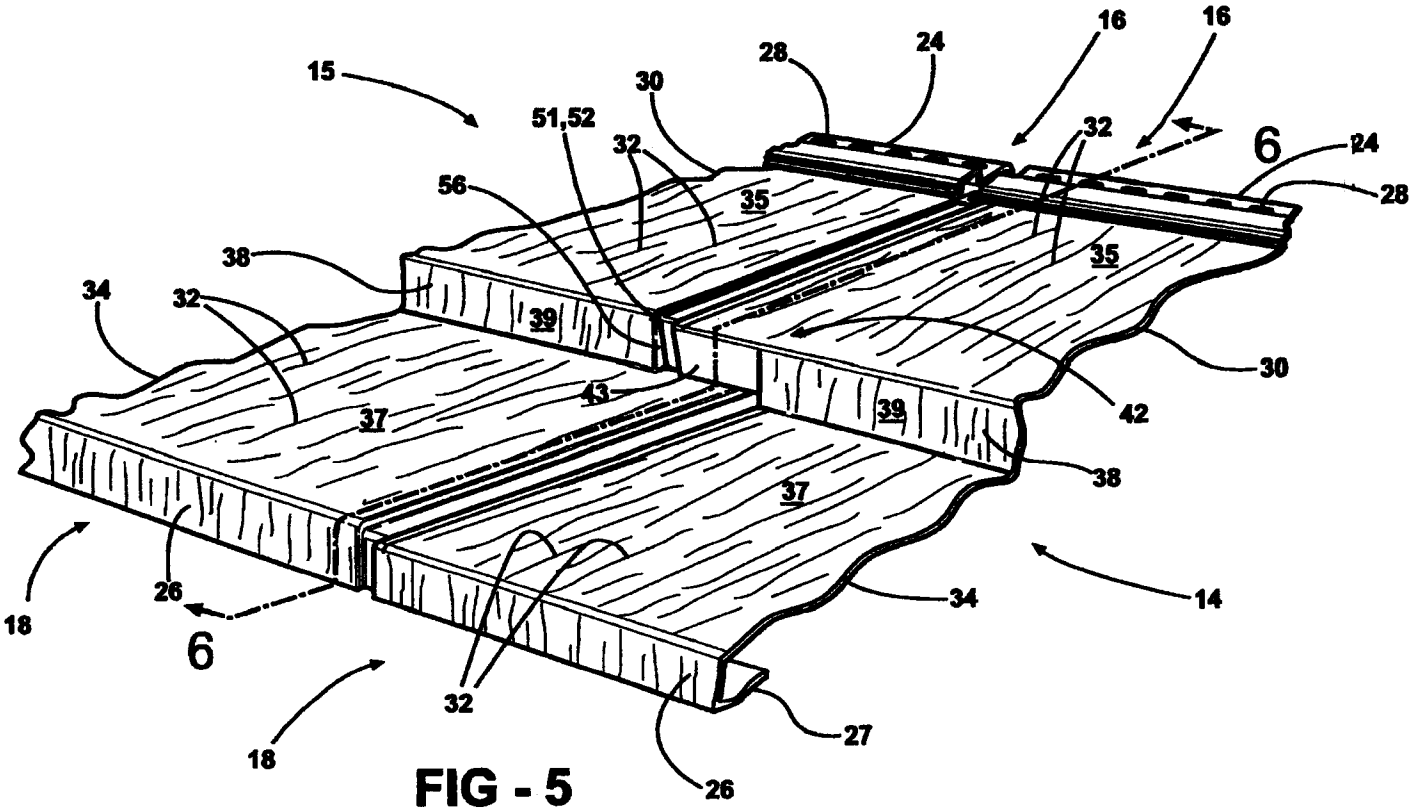
Figure 6A:
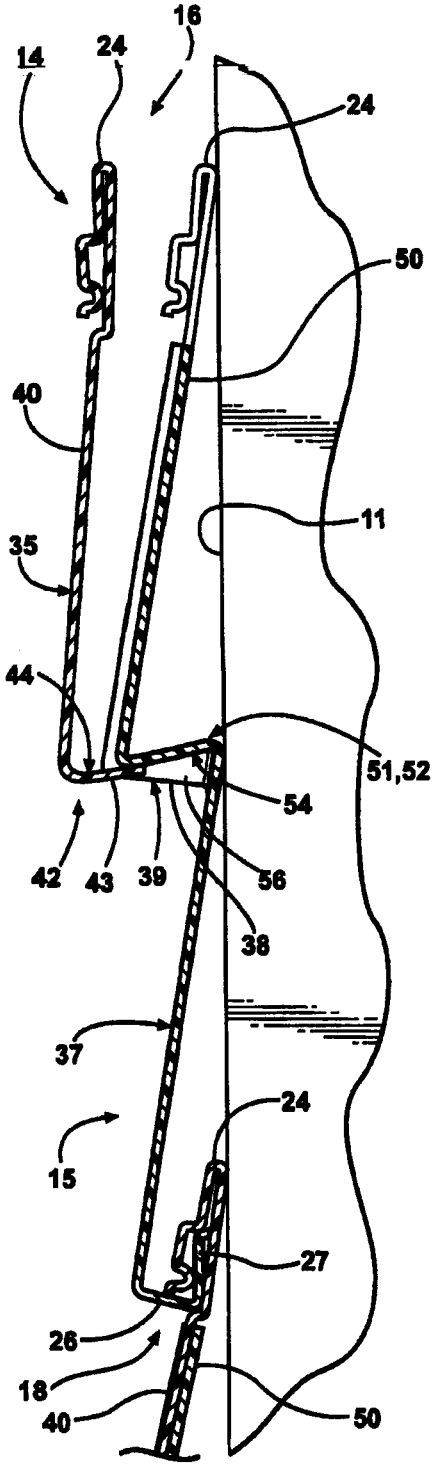
Figure 6B:
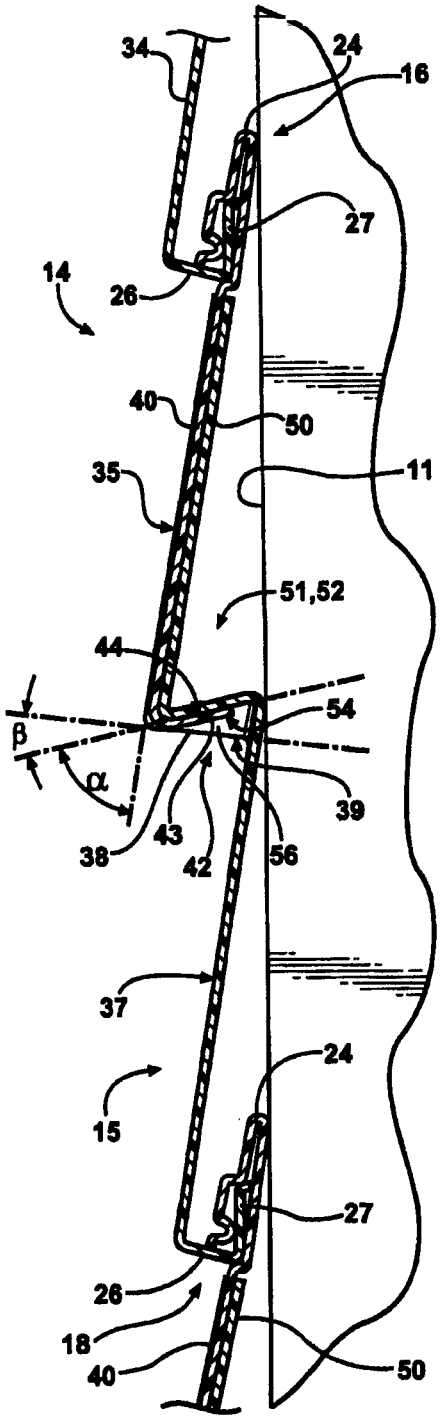
Figure 7:
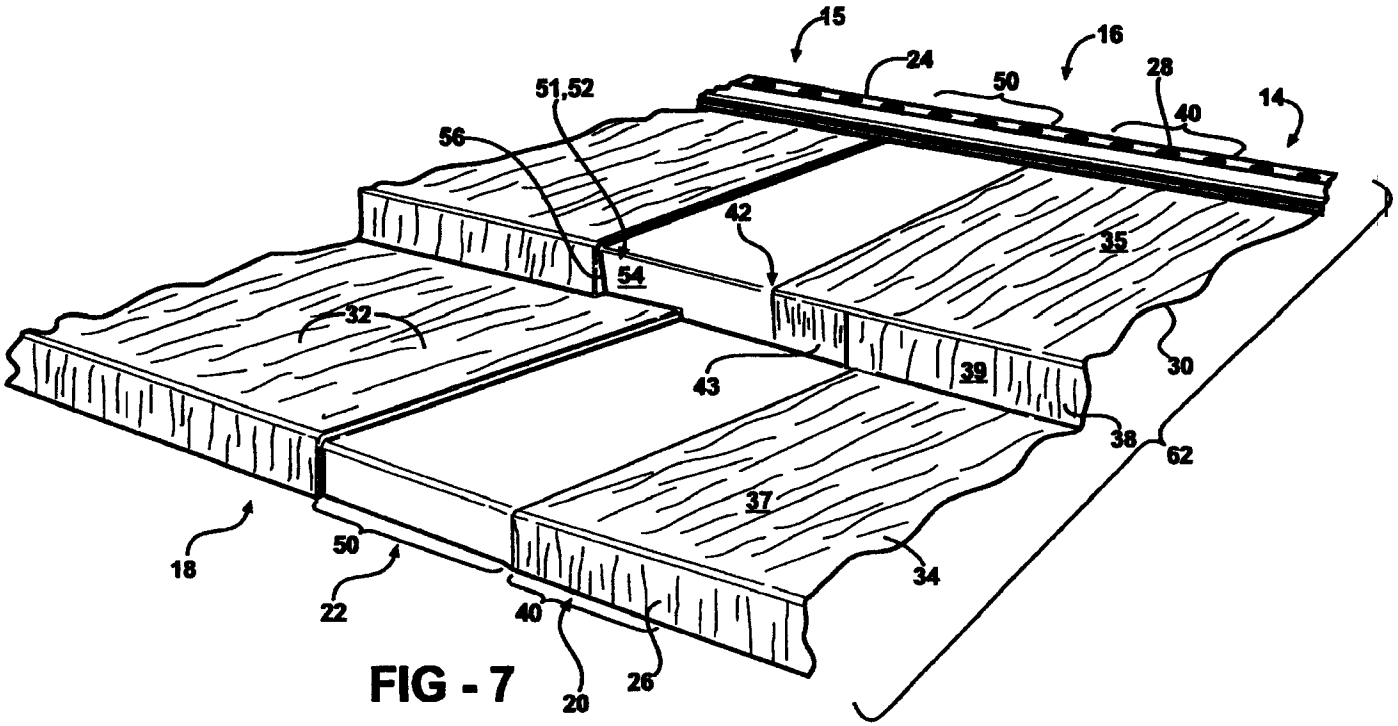

Various methods may be used to form the panels 14 of the present invention. One especially useful method is disclosed in U.S. Pat. No. 6,635,218 to King entitled "Continuous Production of Plastic Siding Panels with Separate Shingle Appearance", which is hereby incorporated by reference. FIG. 7 illustrates a single continuous strip 62 of thermoplastic material that can be cut into individual panels 14. The first and the second ends 20, 22, when formed from such a method, are initially integrally formed together and then cut. When the continuous strip 62 is sectioned into the individual panels 14, the first and second ends 20, 22 are separated to create the appearance shown in FIGS. 4 and 5.

While the invention has been described with reference to an plary embodiment, it will be understood by those skilled in the art that various ges may be made and equivalents may be substituted for elements thereof without departing from the scope of the invention. In addition, many modifications may be made to adapt a particular situation or material to the teachings of the invention without departing from the essential scope thereof. Therefore, it is intended that the invention be limited to the particular embodiment disclosed as the best mode contemplated for carrying out this invention, but that the invention will include all embodiments falling in the scope of the appended claims.

What is claimed is:

1. A system for providing a decorative covering on a support surface, said system comprising:

a plurality of panels, each of said panels having a top and a bottom and first and second ends and including;

a mounting flange adjacent said top, a first row of decorative portions disposed between said top and bottom to define a first front face and a second row of decorative portions disposed between said top and bottom to define a second front face, a riser connecting said first and second rows such that said first row is in a stepped relationship with said second row, a first overlap portion adjacent said first end and a second overlap portion adjacent said second end wherein said first overlap portion is configured for overlapping said second overlap portion of a horizontally adjacent panel mounted to the support surface, and a first interlock having an inner surface extending from said riser at said first end and a second interlock having an outer surface extending from said riser at said second end, said inner and outer surfaces being defined as abutting surfaces sloped upwardly toward said top at an acute angle relative to at least one of said first and second front faces wherein said inner surface overlies and abuts said outer surface of said horizontally adjacent panel at said acute angle to secure said interlocks together and reduce relative movement between said panels when mounted to the support surface.

2. The system as set forth in claim 1 wherein said riser defines a shadow face generally perpendicular to said first and second front faces and each of said abutting surfaces slope upwardly from said riser toward said top at a second acute angle relative to said shadow face.

3. The system as set forth in claim 1 wherein said first interlock includes a flap extending from said riser at said first end and said second interlock is further defined as a catch extending from said riser at said second end for mating engagement with said flap of a second horizontally adjacent panel.

4. The system as set forth in claim 1 wherein said second overlap portion is recessed relative to said first and second front faces to define an abutment for said first overlap portion of a second horizontally adjacent panel to regulate an amount of overlap between adjacent panels and guide mating of said abutting surfaces.

5. The system as set forth in claim 1 including a clamping portion adjacent said bottom having a flexible lip for flexing over said second overlap portion at said bottom of said horizontally adjacent panel to secure said panels together at said bottom.

6. The system as set forth in claim 1 wherein said mounting flange is further defined as a nailing hem.

7. The system as set forth in claim 1 wherein said decorative portions include a plurality of grooves defined in said first and second front faces and extending transversely across said front faces with said grooves being offset between said first front face and said second front face to simulate shake shingles.

8. The system as set forth in claim 1 wherein each of said panels is formed in a unitary sheet of material.

9. The system as set forth in claim 8 wherein each of said panels is cut from a continuous strip of said material.

10. The system as set forth in claim 1 wherein each of said front faces has a width of from about 3 to about 6 inches.

11. The system as set forth in claim 10 wherein each of said front faces has a width of from about 4 to about 5 inches.

12. The system as set forth in claim 1 wherein each of said first and second overlap portions include a first overlapping section and a second overlapping section offset from said first overlapping section to define offset gaps between said panels when interconnected.

13. A panel for decoratively covering a support surface, said panel comprising;

a top and a bottom and first and second ends, a mounting flange adjacent said top, a first row of decorative portions disposed between said top and bottom to define a first front face and a second row of decorative portions disposed between said top and bottom to define a second front face, a riser connecting said first and second rows such that said first row is in a stepped relationship with said second row, a first overlap portion adjacent said first end and a second overlap portion adjacent said second end wherein said first overlap portion is configured for overlapping said second overlap portion of a horizontally adjacent panel mounted to the support surface, and a first interlock having an inner surface extending from said riser at said first end and a second interlock having an outer surface extending from said riser at said second end, said inner and outer surfaces being defined as abutting surfaces sloped upwardly toward said top at an acute angle relative to at least one of said first and second front faces wherein said inner surface overlies and abuts said outer surface of the horizontally adjacent panel at said acute angle to secure said interlocks together and reduce relative movement between the panels when mounted to the support surface.

14. The system as set forth in claim 13 wherein said riser defines a shadow face generally perpendicular to said first and second front faces and each of said abutting surfaces slope upwardly from said riser toward said top at a second acute angle relative to said shadow face.

15. The system as set forth in claim 13 wherein said first interlock includes a flap extending from said riser at said first end and said second interlock is further defined as a catch extending from said riser at said second end for mating engagement with said flap of a second horizontally adjacent panel.

16. The system as set forth in claim 15 including a contact wall interconnecting said riser and said catch such that said riser is raised above said catch to define an abutment for said flap of said second horizontally adjacent panel.

17. The system as set forth in claim 13 wherein said second overlap portion is recessed relative to said first and second front faces to define an abutment for said first overlap portion of a second horizontally adjacent panel to regulate an amount of overlap between adjacent panels and guide mating of said abutting surfaces.

18. The system as set forth in claim 13 including a clamping portion adjacent said bottom having a flexible lip for flexing over said second overlap portion at said bottom of the horizontally adjacent panel to secure the panels together at said bottom.

19. The system as set forth in claim 13 wherein said mounting flange is further defined as a nailing hem.

20. The system as set forth in claim 13 wherein said decorative portions include a plurality of grooves defined in said first and second front faces and extending transversely across said front faces with said grooves being offset between said first front face and said second front face to simulate shake shingles.

21. The system as set forth in claim 13 wherein each of said front faces has a width of from about 3 to about 6 inches.

22. The system as set forth in claim 21 wherein each of said front faces has a width of from about 4 to about 5 inches.

* * * * *

UNITED STATES PATENT AND TRADEMARK OFFICE

CERTIFICATE OF CORRECTION

PATENT NO. : 7,775,009 B2
APPLICATION NO. : 11/613470
DATED : August 17, 2010
INVENTOR(S) : Daniel W. King It is certified that error appears in the above-identified patent and that said Letters Patent is hereby corrected as shown below:

In the Drawings:
Delete Annotated Drawing Sheets 2 through 7, consisting of FIGS. 2 through 7 and substitute therefore the attached Drawing Sheets 2 through 7, consisting of FIGS 2 through 7; and In claims 14 through 22, delete "system as set forth" and replace with -- panel as set forth --.

Signed and Sealed this

Seventh Day of December, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,775,009 B2
APPLICATION NO. : 11/613470
DATED : August 17, 2010
INVENTOR(S) : Daniel W. King It is certified that error appears in the above-identified patent and that said Letters Patent is hereby corrected as shown below:

In the Drawings:

Delete Annotated Drawing Sheets 2 through 7, consisting of FIGS. 2 through 7 and substitute therefore the attached Drawing Sheets 2 through 7, consisting of FIGS 2 through 7; and Column 8, line 7, Claim 14, delete "system as set forth" and replace with --panel as set forth--.

Column 8, line 12, Claim 15, delete "system as set forth" and replace with --panel as set forth--.

Column 8, line 18, Claim 16, delete "system as set forth" and replace with --panel as set forth--.

Column 8, line 22, Claim 17, delete "system as set forth" and replace with --panel as set forth--.

Column 8, line 28, Claim 18, delete "system as set forth" and replace with --panel as set forth--.

Column 8, line 33, Claim 19, delete "system as set forth" and replace with --panel as set forth--.

Column 8, line 35, Claim 20, delete "system as set forth" and replace with --panel as set forth--.

Column 8, line 41, Claim 21, delete "system as set forth" and replace with --panel as set forth--.

Column 8, line 43, Claim 22, delete "system as set forth" and replace with --panel as set forth--.

This certificate supersedes the Certificate of Correction issued December 7, 2010.

Signed and Sealed this
Eighth Day of February, 2011

David J. Kappos

David J. Kappos
*Director of the United States Patent and Trademark Office*